US007726283B2

(12) United States Patent
Vahle

(10) Patent No.: US 7,726,283 B2
(45) Date of Patent: Jun. 1, 2010

(54) PRESSURE BOOSTER ARRANGEMENT

(75) Inventor: Dirk Vahle, Pulverdia (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/349,784

(22) Filed: Jan. 7, 2009

(65) Prior Publication Data

US 2009/0229571 A1 Sep. 17, 2009

(30) Foreign Application Priority Data

Jan. 7, 2008 (DE) ..... 10 2008 003 347

(51) Int. Cl.
*F02M 57/02* (2006.01)
*F02M 63/00* (2006.01)
*F04B 17/00* (2006.01)

(52) U.S. Cl. ..... 123/446; 123/447; 417/401

(58) Field of Classification Search ..... 123/445, 123/446, 447, 467, 460; 92/171.1; 417/392, 417/393, 396, 397, 404
See application file for complete search history.

(56) References Cited

U.S. PATENT DOCUMENTS 3,737,254 A * 6/1973 Swatty ..... 417/403
4,142,497 A * 3/1979 Long ..... 123/456
4,233,000 A * 11/1980 Cox ..... 417/402
4,590,903 A * 5/1986 Hofmann et al. ..... 123/300
4,822,255 A * 4/1989 Eickmann ..... 417/401
7,059,303 B2 * 6/2006 Magel et al. ..... 123/447
7,597,545 B2 * 10/2009 Pedersen et al. ..... 417/225
2007/0095325 A1 * 5/2007 Haiser et al. ..... 123/296

* cited by examiner

*Primary Examiner*—Thomas N Moulis
(74) *Attorney, Agent, or Firm*—Ronald E. Greigg

(57) ABSTRACT

The invention relates to a pressure booster arrangement for high-pressure injection systems or high-pressure injection system parts of internal combustion engines. A differential piston which operates with a large cross section in a medium-pressure reservoir and with partial cross sections is operative in terms of positive displacement in associated control and work pressure chambers that are separate from the medium-pressure reservoir and that are disposed in a guide body. The guide body guides the differential piston in its strokes and in turn axially adjoins a valve body. The valve body receives control and check valves for controlling communicating lines of the guide body and of the valve body for controllably connecting the control and work chambers to the medium-pressure reservoir or to a relatively pressureless fluid reservoir. It is essential to the invention that the valve body and the guide body separate from it, which at least on its end remote from the valve body is acted upon by the pressure in the medium-pressure reservoir, adjoin one another axially with end faces facing toward one another. Between these end faces, a spacer chamber or hollow chamber communicating with the relatively pressureless reservoir is embodied.

11 Claims, 2 Drawing Sheets

PRESSURE BOOSTER ARRANGEMENT

CROSS-REFERENCE TO RELATED APPLICATIONS

This application is based on German Patent Application 10 2008 003 347.2 filed Jan. 7, 2008, upon which priority is claimed.

BACKGROUND OF THE INVENTION

1. Field of the Invention

The invention relates to a pressure booster arrangement for high-pressure injection systems or high-pressure injection system pads of internal combustion engines.

2. Description of the Prior Art

One such pressure booster arrangement is the subject of the earlier German Patent Application 10 2007 021 326.5, not published before the priority date of the present application, and has a differential piston that operates with a large cross section in a medium-pressure reservoir, connected to the compression side of a pump that communicates on one side with a relatively pressureless fluid reservoir, and that is operative with partial cross sections for positive displacement in associated control and work chambers, which are separate from the medium-pressure reservoir and are disposed in a guide body that guides the differential piston in its strokes and in turn axially adjoins a valve body, and the valve body receives control and check valves for controlling communicating lines of the guide body and valve body for controllably connecting the control and work chambers with the medium-pressure reservoir or with the relatively pressureless fluid reservoir.

In operation of the pressure booster arrangement, fluid is forced into he medium-pressure reservoir by means of the pump; as a consequence, the differential piston is retracted, counter to the force of a restoring spring assembly, from a stop disposed in the medium-pressure reservoir and executes a working stroke, in which fluid is expelled from the control and work chambers and forced into a connected high-pressure storage system or into the relatively pressureless reservoir that during the working stroke is connected to the control chamber side. For the ensuing reverse stroke of the differential piston, the work and control chambers communicate with the medium-pressure reservoir, so that the restoring spring assembly returns the differential piston to the outset position again, and the fluid positively displaced by the differential piston in the medium-pressure reservoir in this reverse stroke is forced into the work and control chambers.

The guide body and the valve body have a comparatively complicated structure and should therefore be capable of being manufactured separately from one another. However, if the valve body and guide body are produced as separate segments from one another in a built guide body and valve body, it is necessary for lines of the control body and of the guide body, which lines communicate with one another at the parting plane between the segments, to be sealed off on the sides of these bodies oriented toward one another. Since the corresponding seals must at least in pat be proof against extremely high pressure and are furthermore acted upon by highly varying pressures, in other words pressure pulsations, in accordance with the succession of working and reverse strokes of the differential piston, these seals must be disposed with high sealing pressure. A further difficulty is that upon tensing of the axially joining bodies against one another that is adequate for attaining the sealing pressures, relative motions between sealing faces resting on one another parallel to the parting plane between the bodies must be prevented from occurring. It is true that the axially adjoining bodies fundamentally pin one another or in some other way are coupled together by positive engagement, in such a way that in the region of their parting plane they are hindered from relative motions parallel to the parting plane. However, if the tensing of the axially adjoining bodies is effected by the bodies of set screws embracing them, then the aforementioned pinning or positive engagement must be disproportionately large or strong, so that a satisfactory construction cannot be attained.

OBJECT AND SUMMARY OF THE INVENTION

It is therefore the object of the invention, in a pressure booster arrangement of the type defined at the outset, to make it possible to have a valve body and a guide body that are separate from one another without there being sealing problems when they are put together.

The invention is based on the general concept of utilizing the fluid pressure, prevailing in the medium-pressure reservoir, for thrusting or pressing the guide body against the valve body, in that, by a spacer chamber or hollow chamber disposed between the end faces, toward one another, of the guide body and the valve body and communicating with the relatively pressureless reservoir, a great fluidic pressure difference between the ends remote from one another of the guide body is assured.

Thus pressing seals between adjoining bodies, which is difficult to achieve in the present case by mechanical means, is effected fluidically in the invention.

In a preferred embodiment of the invention, the valve body forms a segment inserted axially between the guide body and a base body that retains the medium-pressure reservoir, and between the valve body and the base body, a further spacer chamber or hollow chamber communicating with the relatively pressureless reservoir is embodied, so that the pressure forces of the fluid in the medium-pressure reservoir, dissipated from the guide body to the valve body, are dissipated indirectly to the base body via the valve body, and the seals required both between the guide body and the valve body and between the valve body and the base body are acted upon fluidically by the desirably high pressing force.

BRIEF DESCRIPTION OF THE DRAWINGS

The invention will be better understood and further objects and advantages thereof will become more apparent from the ensuing detailed description of preferred embodiments taken in conjunction with the drawings. In which.

DESCRIPTION OF THE REFERRED EMBODIMENTS

Figure 1:
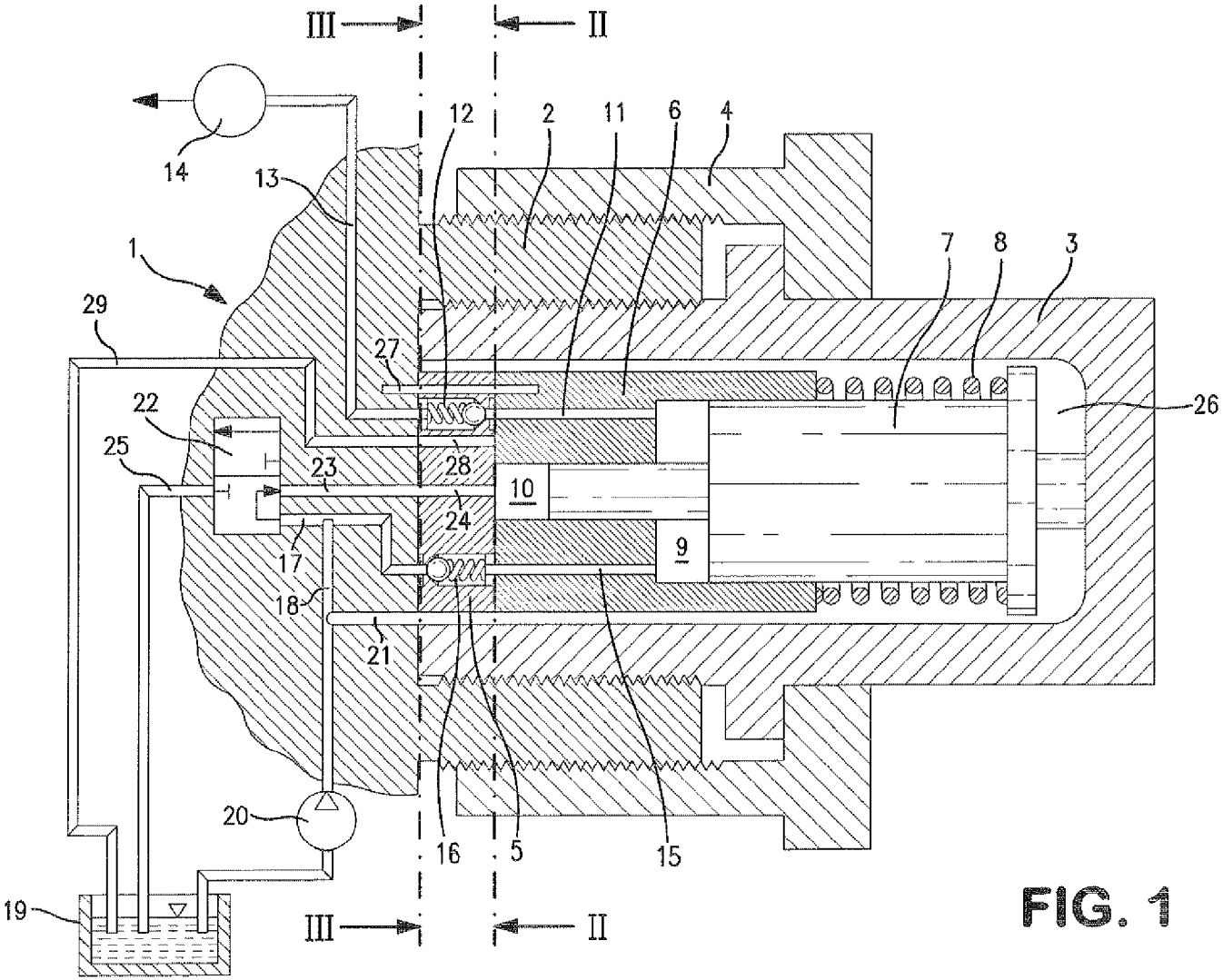
FIG. 1 is an axial section through a pressure booster arrangement of the invention.

The pressure booster shown in FIG. 1 has a base body 1, on which a circular-cylindrical extension 2 is disposed. This extension 2 may have a female thread, into which a cylinder 3, having a corresponding male thread enclosed by a bottom on its end remote from the base body 1, thereby tightly tensing the base body 1.

Instead, it is also possible to provide a male thread on the cylindrical extension 2 and a clamping shoulder, annularly surrounding the outer circumference, on the outer circumference of the cylinder 3, so that the cylinder 3 can be tensed tightly against the base body 1 by means of a lock nut 4.

Inside the cylinder 3, the base body 1 is adjoined axially by both a valve body 5 and a guide body 6. The outside diameters of the valve body 5 and guide body 6 are smaller than the inside diameter of the cylinder 3, so that an annular chamber remains between the inner circumference of the cylinder 3 and the outer circumferences of the valve body 5 and guide body 6.

The guide body 6 is penetrated by a graduated axial bore, which serves the purpose of displaceable guidance of a suitably shaped differential piston 7. The differential piston is acted on by a restoring spring 8, which is embodied as a helical compression spring and is fastened between the front edge, pointing away from the base body 1, of the guide body 6 and an annular flange, disposed on the differential piston 7 on its end remote from the base body 1, and tenses the differential piston 7 into the outset position shown in FIG. 1, in which the differential piston 7 rests in stoplike fashion with an axial extension on the bottom of the cylinder 3.

Inside the graduated axial bore of the guide body 6, an annular control chamber 9 and a central work chamber 10 are partitioned off from one another by the differential piston. The annular chamber 9 communicates, via an axial bore 11 in the guide body 6, with a first check valve 12 disposed in the valve body 5, and this check valve in turn communicates, via a line 13 in the base body 1, with a high-pressure reservoir 14 (for instance a common rail), which communicates on its outlet side with fuel injectors of an injection system of an internal combustion engine. The first check valve 12 is embodied such that it permits a flow only in e direction of the high-pressure reservoir 14. By way of a further line 15, axially penetrating the guide body 6, the annular chamber 9 communicates with a second check valve 16, disposed in the valve body 5, and this valve communicates, on its side remote from the annular chamber 9, with a line 17 in the base body 1. The second check valve 16 is embodied such that it permits a flow only in the direction of the annular chamber 9. The line 17 communicates via a branch 18 with he compression side of a pump 20 connected on its inlet side to a relatively pressureless fuel reservoir 19. From the branch 18, a further branch 21 leads into the interior of the cylinder 3. For that purpose, the further branch 21, on the face end of the base body 1 supporting the valve body 5, has an orifice, which discharges to the annular chamber formed inside the cylinder 3 between the inner circumference of the cylinder 3 and the outer circumference of the valve body 5 and of the guide body 6.

The line 17 also leads to a connection of a switching valve 22, which is embodied as a 3/2-way valve and in the normal position shown connects the line 17 with a line 23, which is connected to the central chamber 10 via a continuation line 24 in the valve body 5.

In its other switching position, the switching valve 22 connects the line 23 with a return 25 leading to the reservoir 19; at the same time, the line 17 is blocked at the switching valve 22.

The pressure booster shown functions essentially as follows:

The interior of the cylinder 3 serves as a medium-pressure reservoir 26 for fuel that is introduced into the medium-pressure reservoir 26 by the pump 20. Let it now be assumed that the medium-pressure reservoir 26, the annular chamber 9, and the central chamber 10 have been filled with fuel in a manner to be described hereinafter; the differential piston 7 has assumed the outset position shown; and the switching valve 22 has assumed the switching position not shown. When the pump 20 is now put into operation, additional fuel is delivered to the medium-pressure reservoir 26 via the branch 21. As a result the differential piston 7 is thrust out of the outset position shown into the guide body 6, counter to the force of the restoring spring assembly 8. As a consequence, on the one hand, fuel is expelled from the central chamber 10 into the return 25 to the reservoir 19, via the switching valve 22. On the other hand, fuel from the annular chamber 9 is forced into the high-pressure reservoir 14, counter to the high pressure in that reservoir 14, via the first check valve 12. Since the differential piston 7 is operative in terms of positive displacement with a large cross section inside the medium-pressure reservoir 26, while in the annular chamber 9 it is operative for positive displacement with a comparatively very small cross section, and in the central chamber 10 it needs to operate against only the practically vanishing pressure in the return 25 or in the reservoir 19, a correspondingly major pressure boost is made possible. Thus as a result, the high-pressure reservoir 14 can be charged to a high pressure that markedly exceeds the medium pressure in the medium-pressure reservoir 26 that is determined by the performance of the pump 20. As soon as the differential piston 7 has attained its terminal position that is thrust into the guide body 6, the switching valve 22 is switched over to the normal position shown. Thus the central chamber 10 communicates with the medium-pressure reservoir 26 via the line 23, the switching valve 22, and the lines 17, 18 and 21, and the annular chamber 9 communicates with the medium-pressure reservoir 26 via the second check valve 16 and the lines 17, 18 and 21, so that the restoring spring 8 can return the differential piston 7 to the outset position shown, and both the annular chamber 9 and the central chamber 10 are filled with fuel. During is phase, the pump 20, if it is embodied as a hydrodynamic pump, can remain in operation and can assure a constant pressure in the medium-pressure reservoir 26. As soon as the switching valve 22 is switched out of the normal position back into its other position, the work of the pump 20 again brings about a delivery of fuel into the medium-pressure reservoir 26, so that the differential piston 7 is thrust back into the guide body 6, and so forth.

Figure 2:
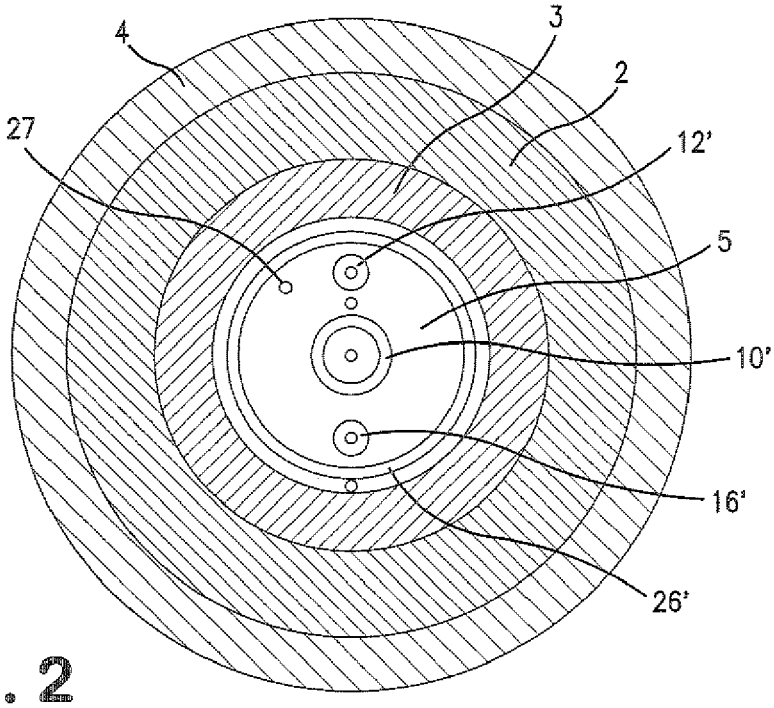
FIG. 2 is a sectional view taken along the line II-II in FIG. 1.
Figure 3:
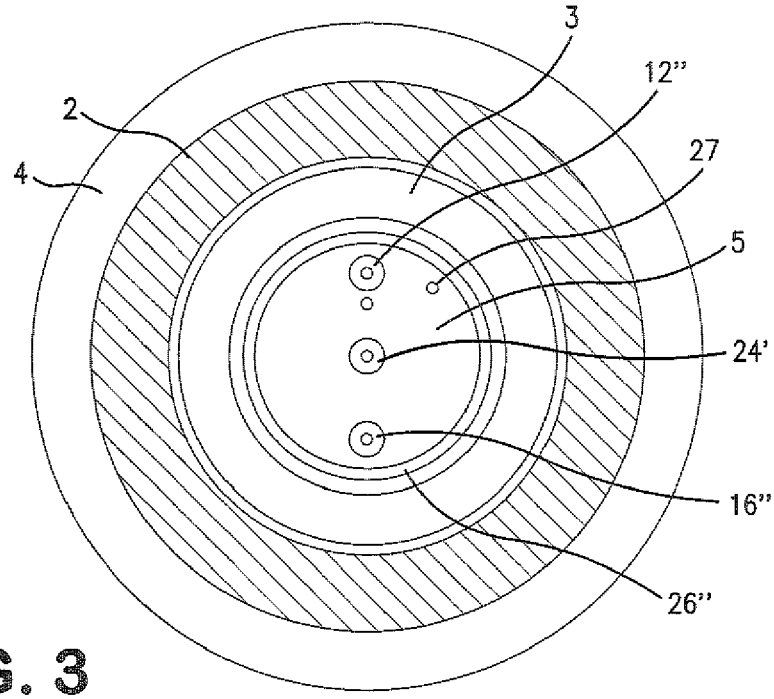
FIG. 3 is a sectional view taken along the line III-III in FIG. 1.

As already described above in the explanation of the invention, it is extremely desirable, for the sake of simplifying manufacture, to be able to manufacture the valve body 5 and the guide body 6 separately from one another, and preferably separately from the base body 1 as well. This means that between these bodies, at the connections of the first check valve 12 and second check valve 16 on face ends of the valve body 5 facing away from one another and at the line 23 between the base body 1 and the valve body 5, seals have to be disposed. FIGS. 2 and 3 show the seals 12', 12" and 16', 16" at the connections of the first check valve 12 and second check valve 16, respectively. FIG. 3 also shows the seal 24' for sealing off the line 24 at the parting plane between the base body 1 and the valve body 5. FIG. 2 furthermore shows a seal 10', with which the central chamber 10 is sealed off at the parting plane between the valve body 5 and the guide body 6.

For the sealing function of the seals mentioned, it is essential that upon assembly of the pressure booster, the seals are subjected solely to pressure in the axial direction, that is, in the axial direction of the valve body 5 and guide body 6. Conversely, the axially adjoining base body 1, valve body 5, and guide body 6 upon assembly, to avoid sealing damage, cannot execute any relative motion whatever parallel to the parting planes between these bodies. This is prevented in the example in FIG. 1 by a pin 27, which penetrates an axial bore in the valve body 5 and protrudes into adjoining bores in the base body 1 and in the guide body 6.

In order to achieve the desired pressure for the aforementioned seals, it is now provided according to the invention that pressureless hollow chambers are created at the parting planes between the valve body 5 and the guide body 6 and preferably also between the base body 1 and the valve body 5, and these hollow chambers are sealed off from the medium-pressure reservoir 26, so that the pressure in the medium-pressure reservoir 26 pushes the guide body 6 against the valve body 5 and thus also pushes the valve body 5 against the base body 1, as a function of the pressure difference between the pressure in the medium-pressure reservoir 26 and the vanishing pressure in the hollow chamber between the bodies 5 and 6. In the hollow chambers, can be embodied disklike flat chambers with a disk plane perpendicular to the axial direction of the valve body 5 and guide body 6. To keep the hollow chambers pressure-free, in the valve body 5 a bore 28 is provided, penetrating the valve body from one face end to another and communicating with both a return line 29, leading to the reservoir 19, and a connecting line to the return 25 in the base body 1. The aforementioned hollow chambers in FIGS. 2 and 3 are blocked off from the medium-pressure reservoir 26 by seals 26' and 26" disposed near the outer edge of the valve body 5.

Upon assembly of the pressure booster, the connection of the base body 1 valve body 5, and guide body 6 is assured by the restoring spring 8, which is braced via the annular flange on the right-hand end, in terms of FIG. 1, of the differential piston 7 on the bottom of the cylinder 3 and is tensed against the facing face end of the guide body 6 and accordingly tenses both the guide body and thus indirectly the valve body 5 as well in the direction of the base body 1. As soon as the medium-pressure reservoir 26 is filled with fuel by means of the pump 20 and is thus put under pressure, the cross section of the guide body 6 is loaded by the hydraulic pressure of the fuel, so that all the aforementioned seals are exposed to a correspondingly high pressure and are also sealingly effective against even extremely high pressure. Preferably, the sealing faces cooperating with one another between the valve body 5 and the guide body 6 on the one hand and between the base body 1 and the valve body 5 on the other are spaced apart somewhat from at least one of the end faces, diametrically opposite one another at the respective hollow chambers, of the base body 1 and valve body 5, and valve body 5 and guide body 6, respectively, so that the entire hydraulic pressure, loading the guide body 6 in the direction of the base body 1, is dissipated via the seals from the guide body 6 to the valve body 5 and from the valve body 5 to the base body 1, and the pressure forces at the seals are maximal.

In a departure from what is shown in FIG. 1, the functions of the annular chamber 9 and the central chamber 10 can also be transposed; that is, all the lines communicating with the central chamber 10 communicate with the annular chamber 9, and the lines communicating with the annular chamber 9 in FIG. 1 are connected to the central chamber 10.

The parting planes visible in FIG. 1 between the base body 1 and the valve body 5 and the between the valve body 5 and the guide body 6 are merely examples in terms of their position. In principle, these parting planes may be provided at some other position instead. In particular, the base body 1, valve body 5, and guide body 6 can in turn be broken down by parting planes into disklike segments, which are then pressed against one another by the hydraulic pressure in the medium-pressure reservoir 26, if in accordance with the invention, hollow or spacer chambers sealed off from the medium-pressure reservoir 26 and communicating with the relatively pressureless reservoir 19 are embodied at the parting planes between the diametrically opposed face ends of the axially adjacent disk bodies and these chambers. In that case, the pin 27 may have to be lengthened in order to pass through all the disklike bodies and to prevent relative motions among the disklike bodies parallel to the plane of the disk.

In all the embodiments of the invention, it is advantageous that it is possible for the pin 27 to be dimensioned comparatively weakly, since to avoid damage to the seals, it has to prevent the aforementioned relative motions between the axially adjoining base body 1, valve body 5, and guide body 6 essentially only during the assembly of the pressure booster arrangement. As soon as the medium-pressure reservoir 26 has been charged with pressure, the base body 1, valve body 5, and guide body 6, or the aforementioned disklike segments of these bodies, are kept relatively immovable relative to one another with nonpositive engagement by means of hydraulic pressure.

As can be seen from FIGS. 2 and 3, the pin 27 is as a rule not disposed in the sectional plane of FIG. 1; it is merely for the sake of better understanding of the function of the pin 27 that it has been located in the sectional plane in FIG. 1.

The foregoing relates to preferred exemplary embodiments of the invention, it being understood that other variants and embodiments thereof are possible within the spirit and scope of the invention, the latter being defined by the appended claims.

I claim:

1. A pressure booster arrangement for high-pressure injection systems or high-pressure injection system parts of internal combustion engines, having a differential piston which operates with a large cross section thereof in a medium-pressure reservoir, and with partial cross sections thereof is operative in terms of positive displacement in an associated control chamber and work chamber that are separate from the medium-pressure reservoir and that are disposed in a guide body, the guide body guiding the differential piston in its strokes and in turn axially adjoining a valve body, the valve body receiving a control valve and a check valves for controlling communicating lines of the guide body and of the valve body for controllably connecting the control chamber and work chamber to the medium-pressure reservoir or to a relatively pressureless fluid reservoir, the valve body and the guide body being separate, wherein the guide body at least on its end remote from the valve body is acted upon by pressure in the medium-pressure reservoir, and the valve body and the guide body adjoin one another axially with respective end faces facing toward one another, and between the end faces, a spacer chamber or hollow chamber communicating with the relatively pressureless reservoir is embodied.

2. The pressure booster arrangement as defined by claim 1, wherein fluid pressure bearing on the end of the guide body remote from the valve body can be dissipated to the valve body via seals, disposed between the end faces, which seals block off the spacer chamber or hollow chamber and/or seal off communicating lines.

3. The pressure booster arrangement as defined by claim 1, wherein on at least one of the end faces, a concavity open toward the other end face is disposed or embodied.

4. The pressure booster arrangement as defined by claim 2, wherein on at least one of the end faces, a concavity open toward the other end face is disposed or embodied.

5. The pressure booster arrangement as defined by claim 1, wherein the valve body, on its side remote from the guide body, axially adjoins a base body that retains the relatively pressureless reservoir, and between the end faces, facing toward one another, of the base body and valve body, a further spacer chamber or hollow chamber communicating with the relatively pressureless reservoir is disposed.

6. The pressure booster arrangement as defined by claim 2, wherein the valve body, on its side remote from the guide body, axially adjoins a base body that retains the relatively pressureless reservoir, and between the end faces, facing toward one another, of the base body and valve body, a further spacer chamber or hollow chamber communicating with the relatively pressureless reservoir is disposed.

7. The pressure booster arrangement as defined by claim 3, wherein the valve body on its side remote from the guide body, axially adjoins a base body that retains the relatively pressureless reservoir, and between the end faces, facing toward one another, of the base body and valve body, a further spacer chamber or hollow chamber communicating with the relatively pressureless reservoir is disposed.

8. The pressure booster arrangement as defined by claim 1, wherein the valve body and the guide body form a built positive-displacement body that protrudes into the medium-pressure reservoir and which is braced in stationary fashion toward the base body.

9. The pressure booster arrangement as defined by claim 2, wherein the valve body and the guide body form a built positive-displacement body that protrudes into the medium-pressure reservoir and which is braced in stationary fashion toward the base body.

10. The pressure booster arrangement as defined by claim 3, wherein the valve body and the guide body form a built positive-displacement body that protrudes into the medium-pressure reservoir and which is braced in stationary fashion toward the base body.

11. The pressure booster arrangement as defined by claim 5, wherein the valve body and the guide body form a built positive-displacement body that protrudes into the medium-pressure reservoir and which is braced in stationary fashion toward the base body.

* * * * *